US008678185B1

(12) United States Patent
Lin

(10) Patent No.: US 8,678,185 B1
(45) Date of Patent: Mar. 25, 2014

(54) TOOL BOX

(71) Applicant: Yi-Hung Lin, Taichung (TW)

(72) Inventor: Yi-Hung Lin, Taichung (TW)

( * ) Notice: Subject to any disclaimer, the term of this patent is extended or adjusted under 35 U.S.C. 154(b) by 0 days.

(21) Appl. No.: 13/707,424

(22) Filed: Dec. 6, 2012

(51) Int. Cl.
*B65D 43/20* (2006.01)

(52) U.S. Cl.
USPC ..... 206/375; 206/45.23; 220/813; 220/345.3

(58) Field of Classification Search
USPC ..... 206/372–379, 751, 762, 45.23; 220/811–813, 345.2, 345.3, 348; 211/70.6
See application file for complete search history.

(56) References Cited

U.S. PATENT DOCUMENTS

| | | | | | |
|---|---|---|---|---|---|
| 1,997,043 | A * | 4/1935 | Clark | 206/246 |
| 4,048,050 | A * | 9/1977 | Hillman | 206/1.5 |
| 4,774,973 | A * | 10/1988 | Gueret | 220/326 |
| 4,946,057 | A * | 8/1990 | Connolly et al. | 220/481 |
| 5,080,222 | A * | 1/1992 | McNary | 206/1.5 |
| 5,160,026 | A * | 11/1992 | Marsh | 206/373 |
| 5,203,469 | A * | 4/1993 | Chang et al. | 220/812 |
| 5,353,947 | A * | 10/1994 | Zinnbauer et al. | 220/812 |
| 5,813,531 | A * | 9/1998 | Kao | 206/373 |
| 6,283,291 | B1 * | 9/2001 | Vasudeva et al. | 206/373 |
| 6,915,900 | B2 * | 7/2005 | Chen | 206/350 |
| 7,775,358 | B1 * | 8/2010 | Huang | 206/379 |
| 7,806,446 | B2 * | 10/2010 | Oh | 292/165 |
| 8,186,510 | B1 * | 5/2012 | Chen | 206/375 |
| 2012/0211384 | A1 * | 8/2012 | Chen | 206/372 |

* cited by examiner

*Primary Examiner* — J. Gregory Pickett
*Assistant Examiner* — Mollie Llewellyn

(57) ABSTRACT

A tool box contains a body including a receiving area formed therein and a stop area, the body also including two slots defined on two opposite sides thereof, and each slot having a cutout defined on a top end thereof and communicating therewith; a cover including two retaining portions arranged on one end thereof and sliding in the two slots, and each retaining portion having a locking recess defined on a bottom end thereof, the cover also including two projections mounted on two inner surfaces thereof; a stopping unit secured in the stop area of the body and moving between an engaging position and a releasing position of the body.

6 Claims, 7 Drawing Sheets

TOOL BOX

FIELD OF THE INVENTION

The present invention relates to a tool box which is capable of taking out a hand tool and a plurality of bits from the tool box easily.

BACKGROUND OF THE INVENTION

A conventional tool box is opened by sliding its cover horizontally and rotating the cover rightward or leftward so that a hand tool and a plurality of bits are taken out. However, such a taking-out way is not easy.

The present invention has arisen to mitigate and/or obviate the afore-described disadvantages.

SUMMARY OF THE INVENTION

The primary object of the present invention is to provide a tool box which is capable of taking out a hand tool and a plurality of bits from the tool box in two selective ways.

Another object of the present invention is to provide a tool box which is capable of taking out a hand tool and a plurality of bits from the tool box easily.

To obtain the above objective, a tool box provided by the present invention contains:

a body including a receiving area formed therein and a stop area, the body also including two slots defined on two opposite sides thereof, and each slot having a cutout defined on a top end thereof and communicating therewith;

a cover including two retaining portions arranged on one end thereof and sliding in the two slots, and each retaining portion having a locking recess defined on a bottom end thereof, the cover also including two projections mounted on two inner surfaces thereof;

a stopping unit secured in the stop area of the body and moving between an engaging position and a releasing position of the body;

wherein the cover is connected with the body and slides among a close position, a parallel open position, and a vertical open position of the body;

wherein when the cover is located at the close position, the stop unit retain in the two slots so that the cover closes the receiving area;

wherein when the cover is located at the parallel open position, the two retaining portions of the cover slide along the two slots so that the receiving area is opened; and wherein when the cover is located at the vertical open position, the two retaining portions of the cover slide out of two cutouts of the two slots, and the cover is rotated along the two projections so that a vertical angle is defined between the cover and the body.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
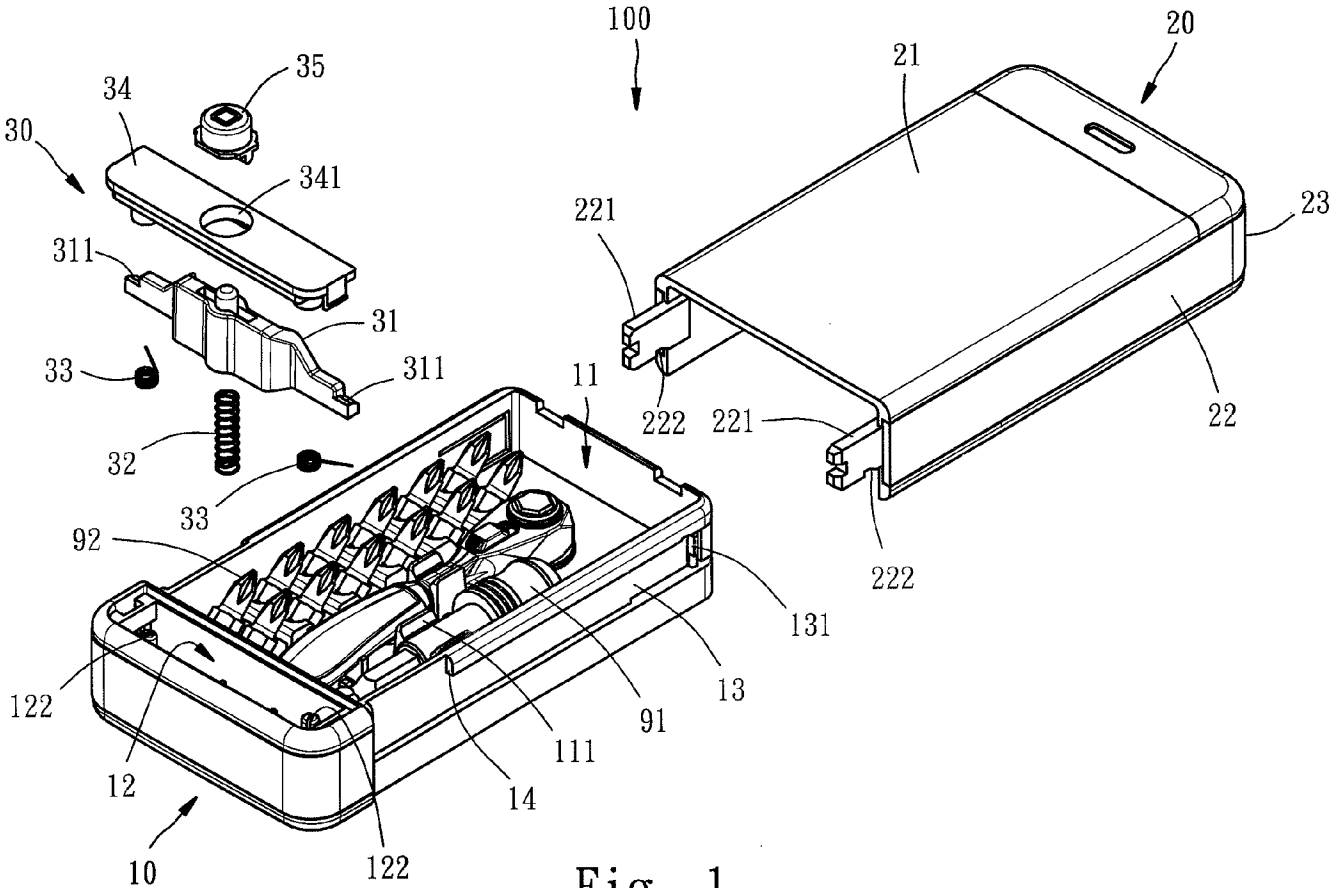
FIG. 1 is a perspective view showing the exploded components of a tool box according to a preferred embodiment of the present invention.
Figure 2:
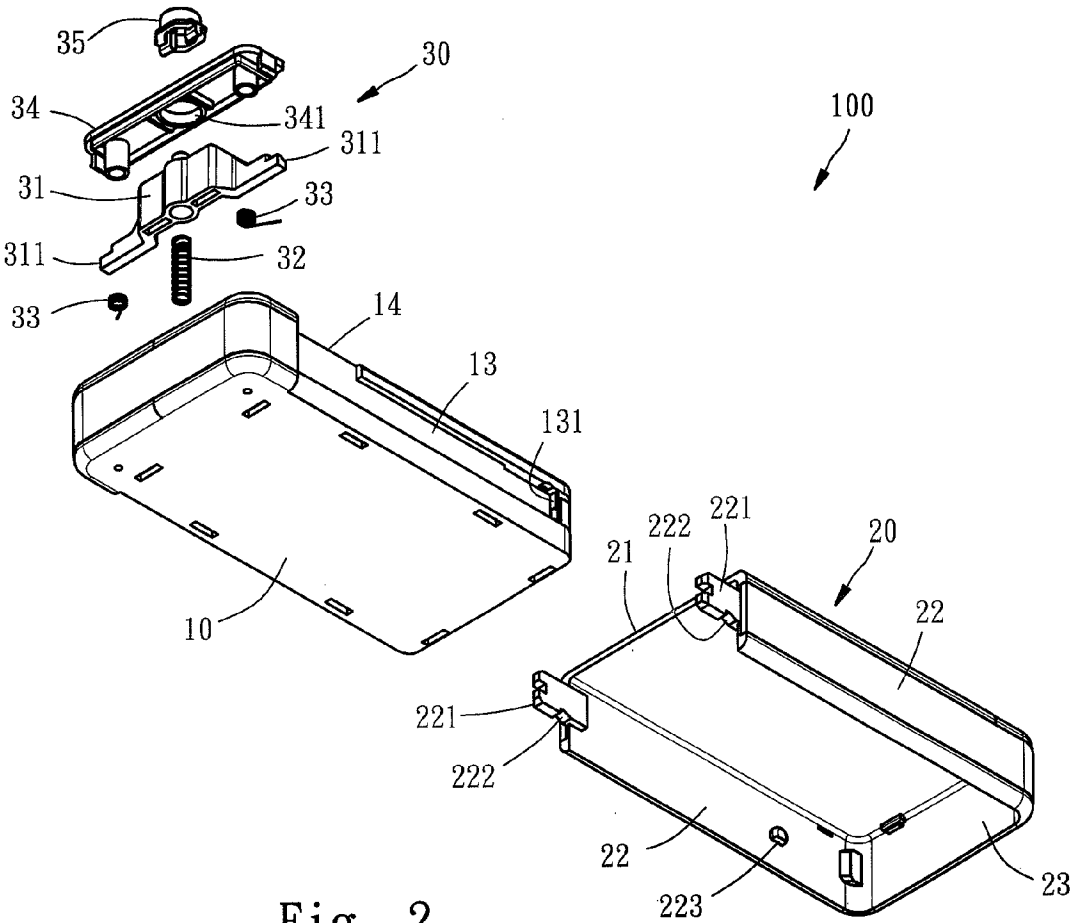
FIG. 2 is another perspective view showing the exploded components of the tool box according to the preferred embodiment of the present invention.
Figure 3:
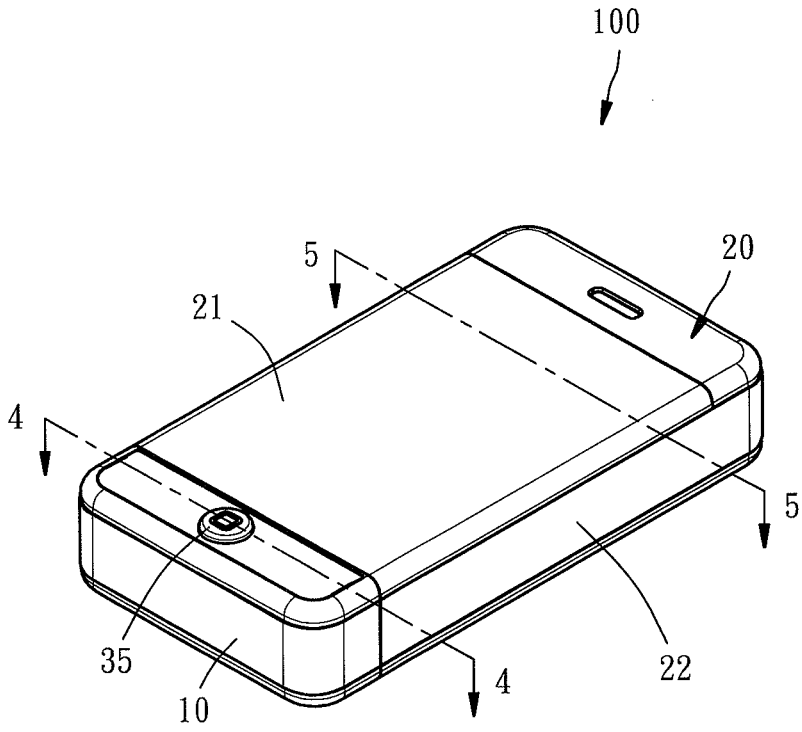
FIG. 3 is a perspective view showing the assembly of the tool box according to the preferred embodiment of the present invention.
Figure 4:
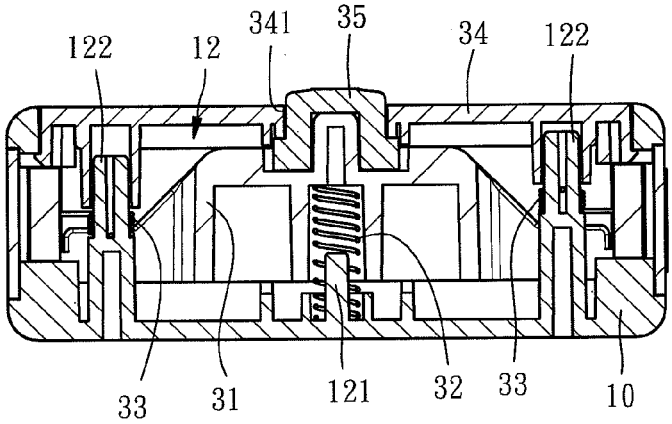
FIG. 4 is a cross sectional view taken along the lines 4-4 of FIG. 3.
Figure 5:
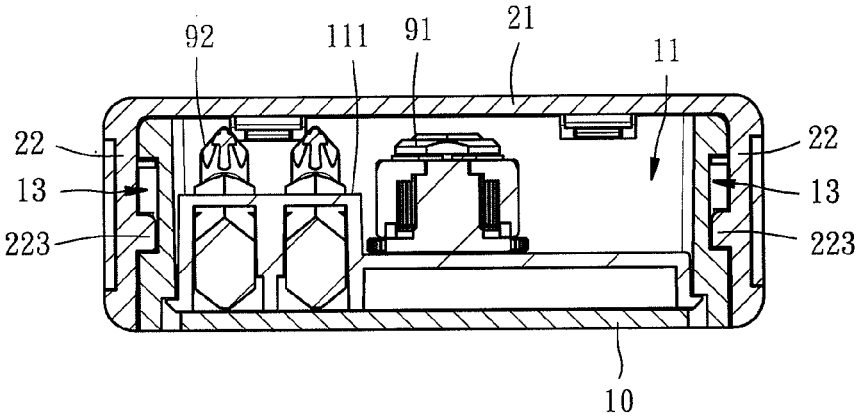
FIG. 5 is a cross sectional view taken along the lines 5-5 of FIG. 3.

With reference to FIGS. 1-10, a tool box 100 according to a preferred embodiment comprises a body 10, a cover, and a stopping unit 30.

Referring further to FIGS. 1-5, the body 10 includes a receiving area 11 formed therein and a stop area 12. The receiving area 11 has a plurality of ribs 111 disposed therein so as to retain a hand tool 91 and a plurality of bits 92. The stop area 12 has a positioning peg 121 fixed therein and two limiting pillars 122 spaced a predetermined distance apart from each other. The body 10 also includes two slots 13 defined on two opposite sides thereof, and each slot 13 has a cutout 14 defined on a top end thereof and communicating with the each slot 13 and has a resilient fence 131 formed on a predetermined position of the each slot 13.

As shown in FIGS. 1-5, the cover 20 is connected with the body 10 and slides among a close position, a parallel open position, and a vertical open position of the body 10.

The cover 20 includes a top plate 21, two side plates 22 connected with two sides of the top plate 21, and an end plate 23 coupled with one end of the top plate 21 and two ends of the two side plates 22. The each side plate 22 of the cover 20 also includes a retaining portion 221 arranged on one end thereof, and the retaining portion 221 has a locking recess 222 defined on a bottom end thereof, the each side plate 22 further includes a projection 223 mounted on an inner surface thereof.

As illustrated in FIGS. 1-5, the stopping unit 30 is secured in the stop area 12 of the body 10 and moves between an engaging position and a releasing position of the body 10.

The stopping unit 30 includes an engagement block 31, a returning spring 32, two limiting springs 33, a lid 34, and a control piece 35. The engagement block 31 is disposed in the stop area 12 of the body 10 and has two lock protrusions 311 mounted on two sides thereof. The returning spring 32 is fixed onto the positioning peg 121 of the stop area 12 and abuts against a region between the engagement block 31 and the stop area 12. The two limiting springs 33 are secured onto the two limiting pillars 122 of the stop area 12 so as to limit a movement of the engagement block 31. The lid 34 is covered on the stop area 12 of the body 10 and has a through hole 341 defined therein. The control piece 35 is positioned in the through hole 341 and connects with the engagement block 31, such that when the control piece 35 is not acted by an external force, the engagement block 31 is pushed by the returning spring 32 to move toward the engaging position of the body 10, and when the control piece 35 is pressed by the external force, the engagement block 31 is driven to move toward the releasing position of the body 10.

Figure 6:
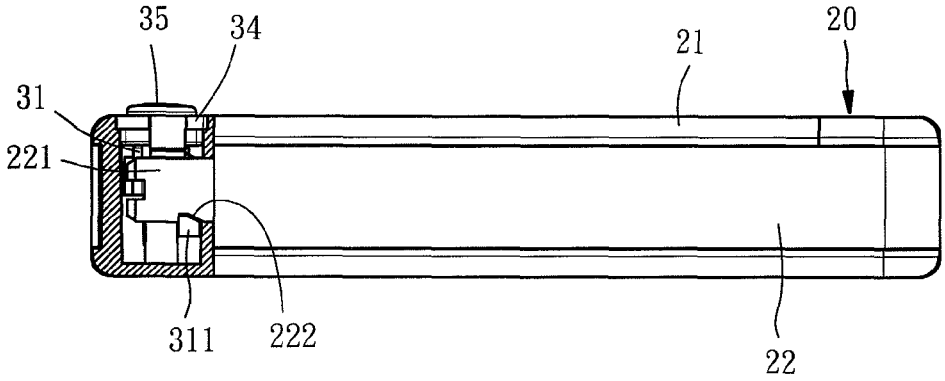
FIG. 6 is a cross sectional view showing the operation of the tool box according to the preferred embodiment of the present invention.

In operation, two retaining portions 221 of the two side plates 22 slide along the two slots 13 so that the cover 20 is located at the engaging position, and the two lock protrusions 311 of the stop unit 30 retain into two locking recesses 222 of the cover 20 (as shown in FIG. 6), hence the cover 20 closes the receiving area 11 of the body 10, and the two side plates 22 of the cover 22 shield the two slots 13 of the body 10.

Figure 7:
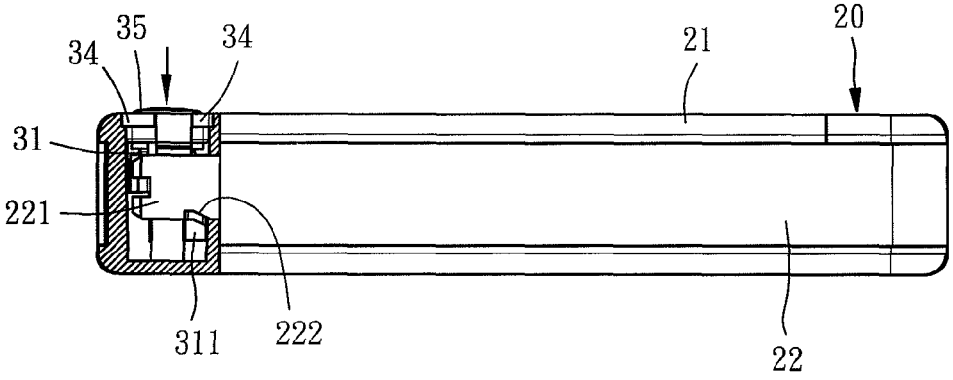
FIG. 7 is another cross sectional view showing the operation of the tool box according to the preferred embodiment of the present invention.
Figure 8:
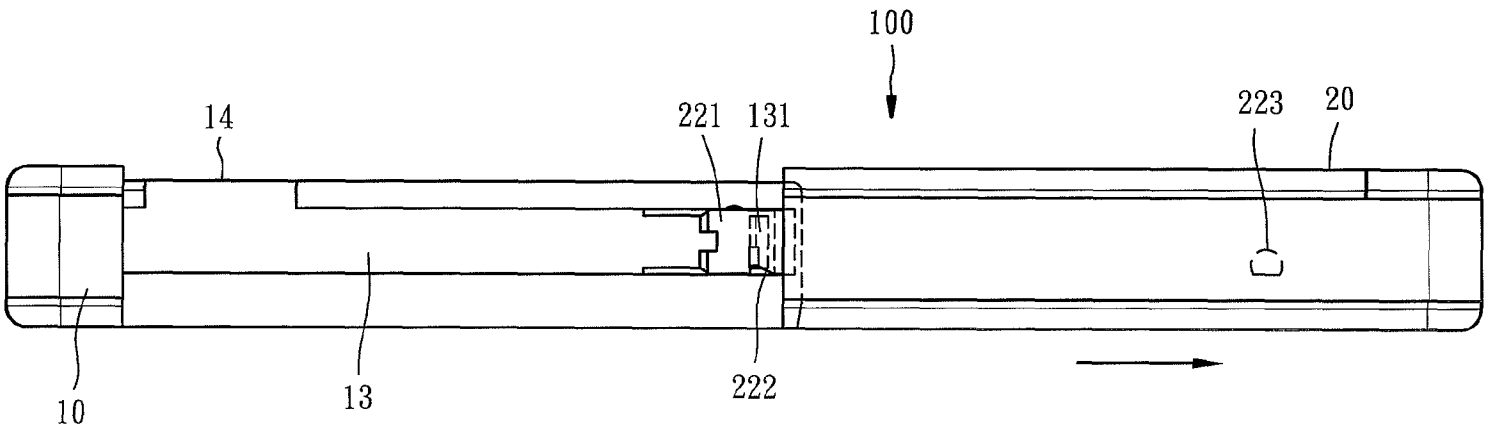
FIG. 8 is a plan view showing the operation of the tool box according to the preferred embodiment of the present invention.

As desiring to open the cover 20 so that the hand tool 91 and the plurality of bits 92 are taken out by the user, the control piece 35 is pressed to drive the two lock protrusions 311 of the engagement block 31, and then the two lock protrusions 311 disengage from the two locking recesses 222 of the cover 20 (as illustrated in FIG. 7). Thereby, the cover 20 slides along the two slots 13, and two projections 223 slide out of two resilient fences 131 of the two slots 13, thereafter the two retaining portions 221 of the two side plates 22 abut against the two resilient fences 131 (as shown in FIG. 8) so that the cover 20 is moved toward the parallel open position of the body 10, hence the receiving area 11 is opened so that the hand tool 91 and the plurality of bits 92 are taken out.

Figure 9:
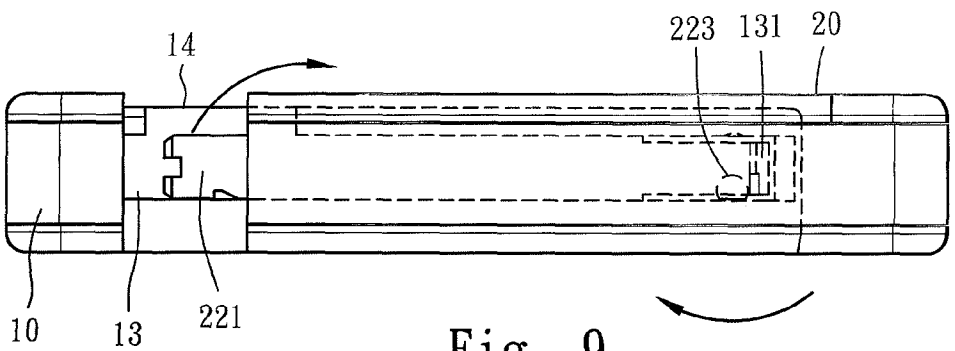
FIG. 9 is another plan view showing the operation of the tool box according to the preferred embodiment of the present invention.
Figure 10:
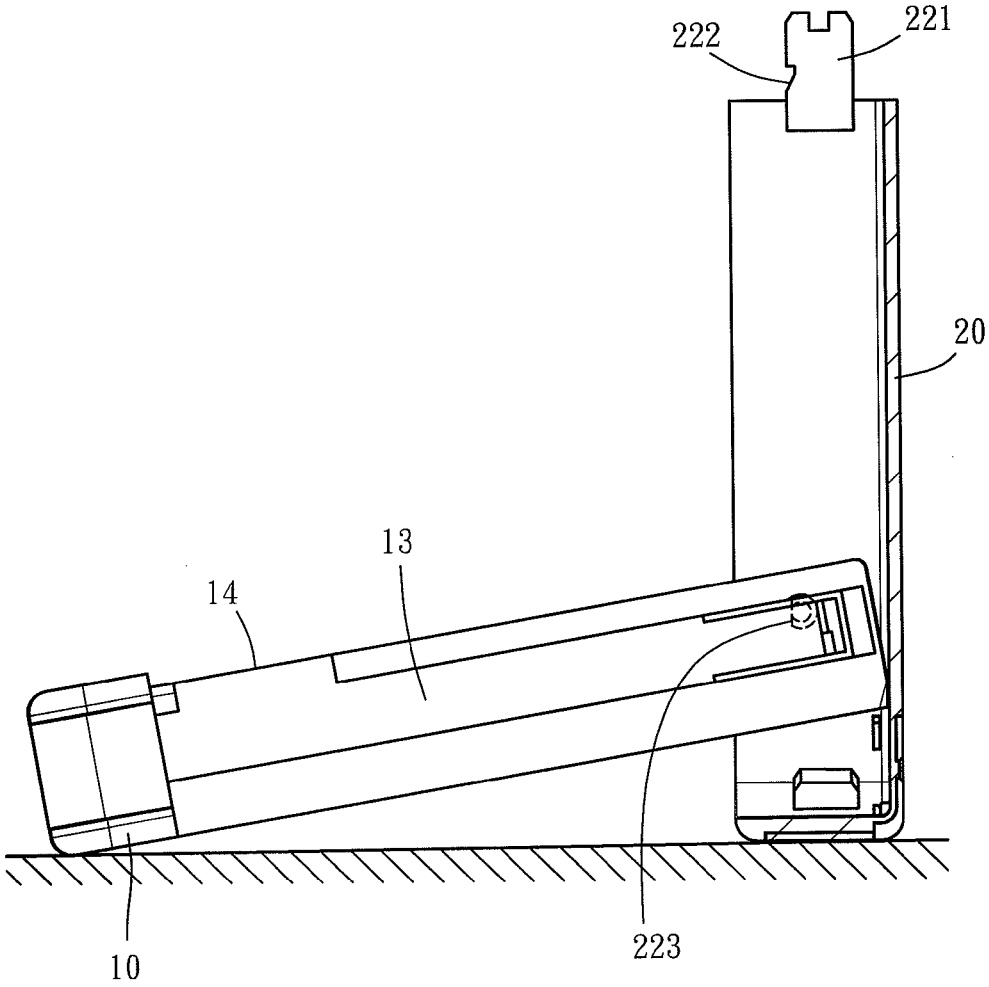
FIG. 10 is also another cross sectional view showing the operation of the tool box according to the preferred embodiment of the present invention.

Also, the control piece 35 of the stop unit 30 is pressed to drive the two lock protrusions 311 of the engagement block 31, and then the two lock protrusions 311 disengage and move to the two locking recesses 222 (as illustrated in FIG. 7). Thereafter, the two retaining portions 221 of the cover 20 slide to two cutouts 14 along the two slots 13 (as shown in FIG. 9), and the cover 20 is rotated so that the two retaining portions 221 of the two side plates 22 slide out of the two cutouts 14, and two projections 223 are used as an axis center so that a vertical angle is defined between the cover 20 and the body 10, and a bottom end of the cover 20 places on a flat surface so that the cover 10 is placed obliquely (as illustrated in FIG. 10). Thereby, not only the receiving area 11 of the body 10 is opened, but also the cover 10 is placed obliquely so that the hand tool 91 and the plurality of bits 92 are taken out easily.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A tool box comprising:

a body including a receiving area formed therein and a stop area, the body also including two slots defined on two opposite sides thereof, and each slot having a cutout defined on a top end thereof and communicating therewith;

a cover including two retaining portions arranged on one end thereof and slidable in the two slots, and each retaining portion having a locking recess defined on a bottom end thereof, the cover also including two projections mounted on two inner surfaces thereof;

a stopping unit secured in the stop area of the body and movable between an engaging position and a releasing position of the body;

wherein the cover is connected with the body and slidable among a closed position, a parallel open position, and a vertical open position of the body;

wherein when the cover is located at the closed position, the stop unit engages the retaining portion so that the cover closes the receiving area;

wherein when the cover is located at the parallel open position, the two retaining portions of the cover are slid along the two slots so that the receiving area is opened; and wherein when the cover is located at the vertical open position, the two retaining portions of the cover are slid out of the cutouts of the two slots, and the cover is rotated about the two projections so that a vertical angle is defined between the cover and the body.

2. The tool box as claimed in claim 1, wherein the receiving area has a plurality of ribs disposed therein so for retaining a hand tool and a plurality of bits.

3. The tool box as claimed in claim 1, wherein each slot has a resilient fence formed on a predetermined position thereof;

when the cover is located at the parallel open position, the two retaining portions of the cover are slid out of the resilient fences of the two slots, and when the cover is located at the vertical open position, the two projections of the cover are located at the resilient fences.

4. The tool box as claimed in claim 1, wherein the cover includes a top plate, two side plates connected with two sides of the top plate, and an end plate coupled with one end of the top plate and two ends of the two side plates; each side plate includes one of said two retaining portions arranged on one end thereof and one of said two projections mounted on an inner surface thereof.

5. The tool box as claimed in claim 1, wherein the stopping unit includes an engagement block, a returning spring, two limiting springs, a lid, and a control piece; the engagement block has two lock protrusions mounted on two sides thereof, the returning spring abuts against the engagement block and a wall of the stop area, the two limiting springs are secured in the stop area so as to limit a movement of the engagement block, the lid covers the stop area of the body and has a through hole defined therein, the control piece is positioned in the through hole and connects with the engagement block, such that when the control piece is not acted upon by an external force, the engagement block is pushed by the returning spring to move toward the engaging position of the body so that the two lock protrusions are retained in the locking recesses of the retaining portions, and when the control piece is pressed by an external force, the engagement block is driven to move toward the releasing position of the body so that the two lock protrusions disengage from the two locking recesses.

6. The tool box as claimed in claim 5, wherein the stop area has a positioning peg fixed therein and two limiting pillars spaced a predetermined distance apart from each other; the returning spring is fixed onto the positioning peg of the stop area, and the two limiting springs are secured onto the two limiting pillars of the stop area.

* * * * *